US006745736B2

(12) United States Patent
Walters

(10) Patent No.: US 6,745,736 B2
(45) Date of Patent: Jun. 8, 2004

(54) VALVE CONTROL MECHANISM

(76) Inventor: Christopher Paulet Melmoth Walters, East Kingston House, Kingston Lane, East Preston, Littlehampton, West Sussex (GB), BN16 1RS ( * ) Notice: Subject to any disclaimer, the term of this patent is extended or adjusted under 35 U.S.C. 154(b) by 0 days.

(21) Appl. No.: 10/275,524

(22) PCT Filed: May 17, 2001

(86) PCT No.: PCT/GB01/02192

§ 371 (c)(1),
(2), (4) Date: Nov. 5, 2002

(87) PCT Pub. No.: WO01/88345

PCT Pub. Date: Nov. 22, 2001

(65) Prior Publication Data

US 2003/0192496 A1 Oct. 16, 2003

(51) Int. Cl.[7] ..... F01L 1/34

(52) U.S. Cl. ..... 123/90.18; 123/90.17; 123/90.15

(58) Field of Search ..... 123/90.18, 90.17, 123/90.15, 90.16

(56) References Cited

U.S. PATENT DOCUMENTS 6,474,281 B1 * 11/2002 Walters ..... 123/90.18

FOREIGN PATENT DOCUMENTS

| | | |
|---|---|---|
| DE | 4229186 | 3/1994 |
| GB | 1296157 | 8/1970 |
| GB | 2203489 | 10/1988 |
| GB | 2341659 | 3/2000 |

* cited by examiner

*Primary Examiner*—Thomas Denion
*Assistant Examiner*—Zelalem Eshete
(74) *Attorney, Agent, or Firm*—Rader, Fishman & Grauer PLLC

(57) ABSTRACT

A valve control mechanism for an internal combustion engine includes a camshaft carrying cams which cooperate with and thereby actuate valves which control the induction of fluids into, and the exhaustion of fluids from, a combustion cylinder during the operating cycle of an engine. The camshaft is axially movable within a predetermined range of movement. At least one of the cams has a profile which, when viewed in a plane perpendicular to the axis of the camshaft, varies as a function of the position along the camshaft axis and is such that, when the camshaft is moved axially to one extreme of its permitted movement, interaction between the cam and the valve with which it is associated generates no valve movement when the cam is rotated.

5 Claims, 3 Drawing Sheets

VALVE CONTROL MECHANISM

This invention relates to a valve control mechanism for an internal combustion engine, to engines containing such mechanisms and to a method of operating the valves of an internal combustion engine.

Our British Patent No. 2 190 140 describes and claims a valve control mechanism which comprises: a camshaft carrying a plurality of cams, the camshaft being mounted in a cam carrier and being arranged for a limited degree of axial movement and having associated with it means for effecting such movement, each of the cam surfaces having an outline, in a section plane containing the axis of the camshaft, which is not parallel to that axis, whereby in use the valve action is a function of the axial location of the camshaft within the range of permitted axial movement, the mechanism also comprising a cam follower for each cam, the cam follower comprising a one-piece body which reciprocates within a slideway and at one extremity acts upon the end of a valve stem through only a shim and has at the opposite extremity a trough of part-circular cross-section which receives a member in the form of a segment of a circular cylinder, the curved surface of which faces the interior surface of the trough, so that said member can turn with respect to said body, whilst a planar side surface of the member faces the cam surface. The present invention offers developments derived from this earlier valve control mechanism.

Our British Patent Application No. 2 341 659A (published Mar. 22, 2000) describes and claims, in or for use in an internal combustion engine, a valve control mechanism which comprises: a camshaft carrying a plurality of cams, the camshaft being mounted in, or being adapted to be mounted in, a cylinder head or cam carrier, the valve control mechanism further including means for relatively advancing and retarding the rotation of the camshaft, said advance/retard means comprising a piston housed and axially displaceable within a cylinder, the axial position of said piston being under hydraulic control, and a mechanical coupling between said piston and the camshaft, said mechanical coupling serving to translate the axial movement of said piston into relative rotational movement of said camshaft.

The present invention is concerned with a valve control mechanism of the type disclosed in GB 2 190 140B, with or without the additional features disclosed in GB 2 341 659A. The disclosure of GB 2 190 140B and of GB 2 341 659A is incorporated herein by reference thereto.

More particularly, the present invention provides in or for use in an internal combustion engine, a valve control mechanism including a camshaft carrying a plurality of cams, the cams cooperating with and thereby serving to actuate valves which control the induction of fluids into, and the exhaust of fluids from, a combustion cylinder during the operating cycle of the engine; wherein:

(i) said camshaft is arranged to be movable axially within a predetermined range of movement;

(ii) at least one of the cams has a profile which, when viewed in a plane perpendicular to the axis of the camshaft, varies as a function of the position along the camshaft axis; and (iii) the profile of said one cam is such that, when the camshaft is moved axially to one extreme of its permitted movement, interaction between the cam and the valve with which it is associated generates no valve movement when the cam is rotated.

In one embodiment of this invention, the profile of said one cam is such that, when the camshaft is moved axially to one extreme of its permitted movement, interaction between the cam and the valve with which it is associated generates no valve lift, thereby preventing opening of the valve.

In another embodiment, the profile of said one cam is such that, when the camshaft is moved axially to one extreme of its permitted movement, interaction between the cam and the valve with which it is associated maintains the valve in an open condition.

Valve control mechanisms in accordance with this invention may be used to disable one or more of the combustion cylinders in an engine; such disablement provides benefits in terms of fuel economy.

The systems described in GB 2 341 659A allow considerable variation in the valve operating cycles; controlled variation of valve lift, valve timing and the duration of the "valve open" and "valve closed" phases are possible. Appropriate design of the cam profile used in such a system thus makes it possible to operate the engine with almost any predetermined valve/cam lift plot, and to adjust the operating conditions during running of the engine as desired. Systems of this sort will be termed herein VVLDT systems ("variable valve lift/duration/timing").

It will be appreciated that the features described in GB 2 341 659A permit control of the valve lift and duration with different cam profiles varying infinitely within two limits (through the axial displacement of the camshaft) and of the valve timing (through the rotational adjustment of the camshaft). When these three functions operate together, the duration of valve opening, their angular shift and the envelope of the curve obtained by plotting valve position against time can also be adjusted.

In a valve control mechanism in accordance with the invention, each cam generally has associated therewith a cam follower. Preferably, each cam follower comprises a body which reciprocates within a slideway and at one extremity acts upon the end of a valve stem, the cam follower having at its opposite extremity a trough of curved cross-section which receives a member in the form of a segment having on one side thereof a surface curved correspondingly to that of said trough, and having on the other side thereof a planar surface, whereby the curved surface of the segment enables said member to turn with respect to said body, while the planar surface of the member cooperates with the cam surface.

Preferably, the cam followers are disposed relative to the valve stems such that the zone of action between the each cam follower and the end of its respective valve stem is located away from the mid-point (measured in a direction parallel to the axis of the camshaft) of a section through the cam follower in a plane which contains the axis of the camshaft and the axis of the valve stem. A particularly preferred arrangement is where said end of the valve stem is partly recessed within the body of the cam follower.

In the present invention, the profile of each cam may be such that a line connecting the points of maximum radial extent of the cam at opposite ends (in the direction of the camshaft axis) thereof is non-parallel to the axis of the camshaft. Cams of this type of profile are described as swashed cams. When viewed in the direction of the camshaft axis, cams of this sort display a phase angle between the camshaft axis and the line marking the "noses" of the cam profile. Using cams of this structure allows more extended control of valve action, in particular timing, when the camshaft undergoes axial displacement.

For a better understanding of the invention, and to show how the same may be carried into effect, reference will now be made to the accompanying drawings, in which.

Figure 1:
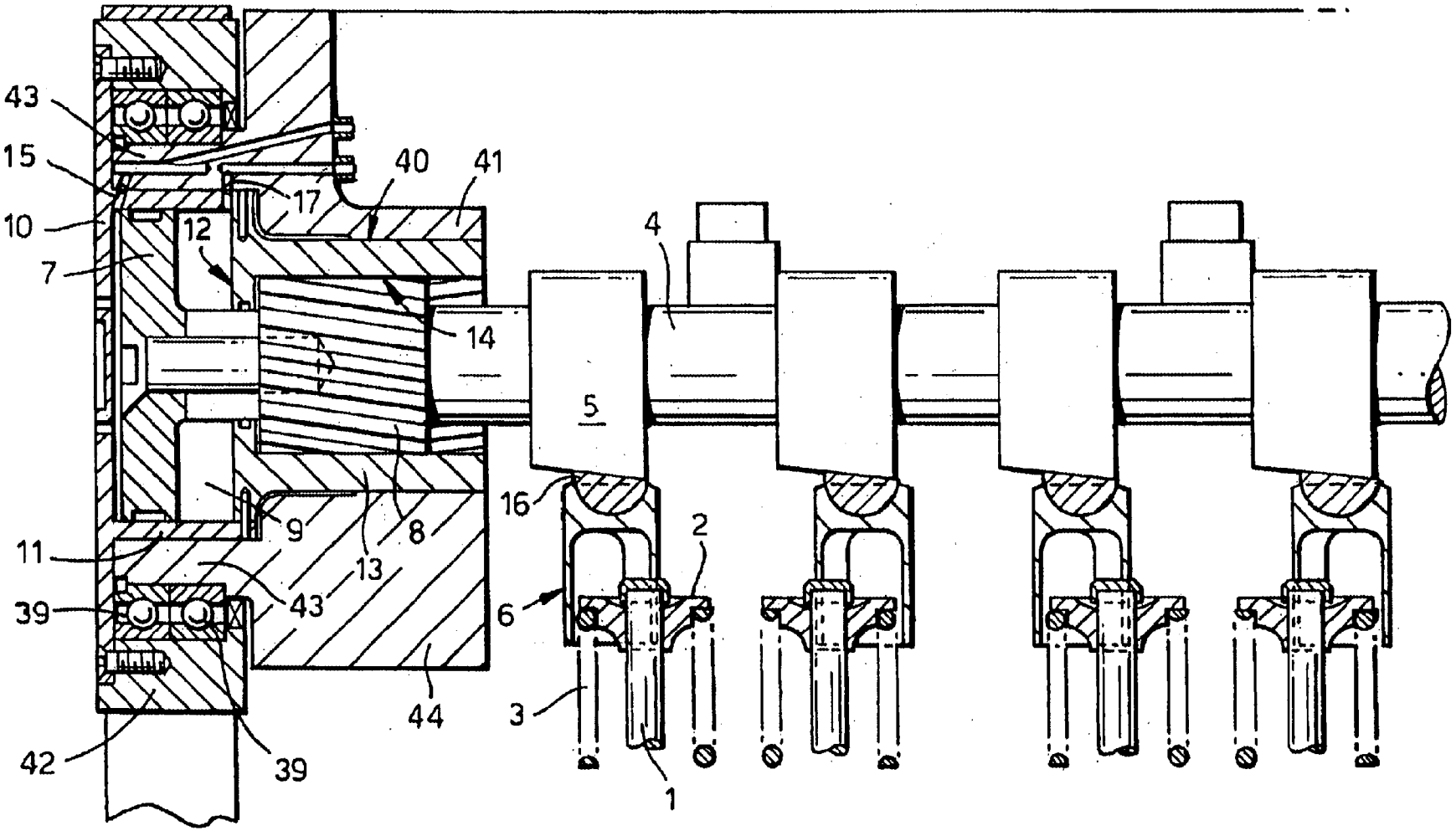
FIG. 1 is taken from GB 3 341 659A and shows part of an internal combustion engine including a VVLDT system.

Referring now to FIG. 1 of the drawings, a valve control mechanism of this invention is depicted and comprises an overhead camshaft 4 which carries a plurality of profiled cams 5. Each of the cams 5 cooperates with a half roller 16 which sits in a recess 19 formed on the upper surface of a rectangular cam follower body 6. The half roller 16 is in the form of a segment of a circular cylinder and is free to rotate about its longitudinal axis while seated in the recess 19. Valve stem 1 cooperates with cam follower body 6 and is held in place by retainers 2 (only the upper retainer is shown in the drawings) and compression springs 3.

The cam profiles are three dimensional, i.e. valve lift varies tangentially with cam angle in end view and varies along the camshaft linearly at each cam angle in side view. If desired, the profile of each cam may be such that a line connecting the points of maximum radial extent of the cam at opposite ends (in the direction of the camshaft axis) thereof is non-parallel to the axis of the camshaft.

The front end of camshaft 4 is connected to a piston 7 located within a cylinder 9 through the intermediary of a spline 8. The chamber of cylinder 9 is defined by a front plate 10 and by an annular flange 11 integral with plate 10; the rear face 12 of the chamber is part of a housing 13 which contains the spline 8. The inner surface 14 of housing 13 is provided with a screw thread (not shown) which cooperates with spline 8 so that axial movement of the spline relative to the housing 13 causes rotation of the spline.

Housing 13 acts as a carrier for spline 8 and, through the action of bearing surface 40, constitutes an outer bearing for the front end of camshaft 4 within cylinder head or carrier 41. An inner bearing for the front end of camshaft 4 is provided by the outer diameter of splines 18 and the inner spline track diameter in 13. These two (outer and inner) bearings are supported on camshaft pulley bearings 39 via elements 13 and 11, and camshaft pulley 42. The camshaft pulley bearings 39 can accept radial and axial loads and provide a stiffer than conventional means of mounting the camshaft pulley on a circular ring 43 which forms part of the cylinder head structure together with parts 41 and 44.

Axial movement of the piston 7 and spline 8 is caused by the supply of oil under pressure to chamber 9 via inlets 15 and 17; oil is supplied to these inlets from proportional programmable valves, e.g. "Moog" valves (not shown). By controlling the hydraulic pressures at inlets 15 and 17, piston 7 is caused to move axially within chamber 9, thereby moving spline 8 and camshaft 4 by a corresponding axial amount. This movement, in turn, causes an additional rotational movement of spline 8 thereby rotationally advancing or retarding the camshaft within pre-set limits.

The effect of axial movement of camshaft 4 will be discerned from FIG. 1: movement to the left causes the valve stem 1 to rise relative to its previous position at the same point in its cycle, thus giving greater valve lift and, if desired, a change in camshaft duration. The rotational advancement imparted by spline 8 additionally advances the valve timing. Movement to the right reverses these effects.

Figure 2:
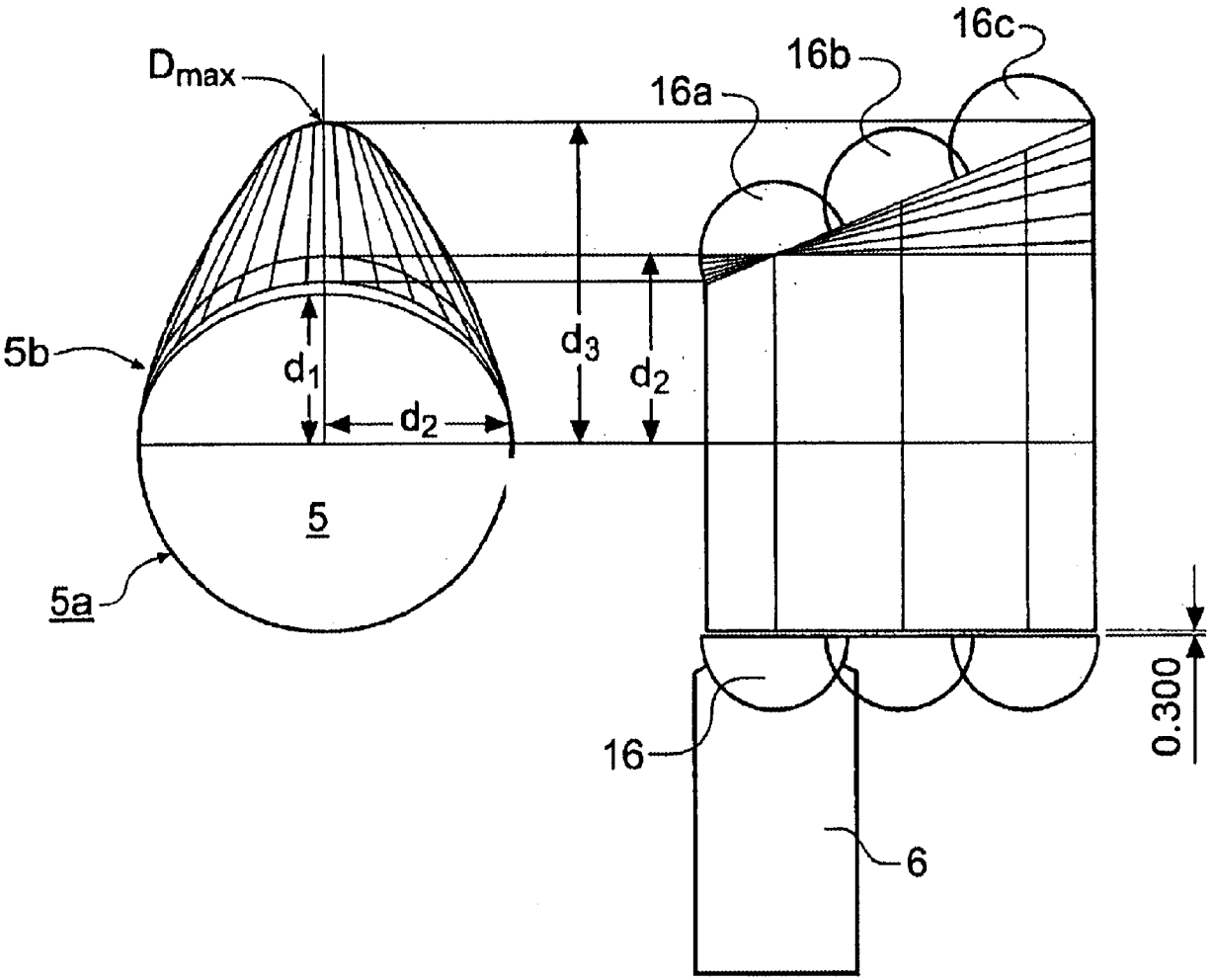
FIG. 2 illustrates a cam profile and how it affects the extent of valve lift.

Referring to FIG. 2, a cam 5 is illustrated in section perpendicular to the axis of the camshaft 4 of FIG. 1. The cam profile tapers from the maximum lift end (at the point $D_{max}$) to the base circle diameter close to the opposite end of the cam, and then reduces further so that, at the minimum lift end of the cam, the radius is less than that of the base circle of the cam. The axial extent between the latter two positions corresponds to the radius of roller 16, as apparent from FIG. 2.

The lower portion 5*a* of cam 5 as seen in FIG. 2 has a circular profile of radius $d_2$; the upper portion 5*b* at one end of the cam has a generally elliptical profile with a minimum radius of $d_1$ which is less than $d_2$; whereas at the opposite end of cam 5, the upper portion 5*b* has a substantially parabolic profile whose maximum radius is $d_3$. When the zone of action between can 5 and roller 16 is varied as a result of the axial displacement of camshaft 4, the effect on the valve with which the cam is associated can be seen from the projection drawn in the right hand portion of FIG. 2. Here, the variation of profile between the opposite ends of the cam is shown to be linear, although non-linear profiles may be adopted if desired. The positions of roller 16 are illustrated at 16*a*, 16*b* and 16*c*. At 16*a*, rotation of the camshaft and hence of cam 5 has no significant effect on the position of the roller, and hence no movement is imparted to the valve stem 1 (see FIG. 1). At position 16*c*, the maximum movement in the valve stem occurs; and at 16*b* the degree of movement is an intermediate value.

Figure 3:
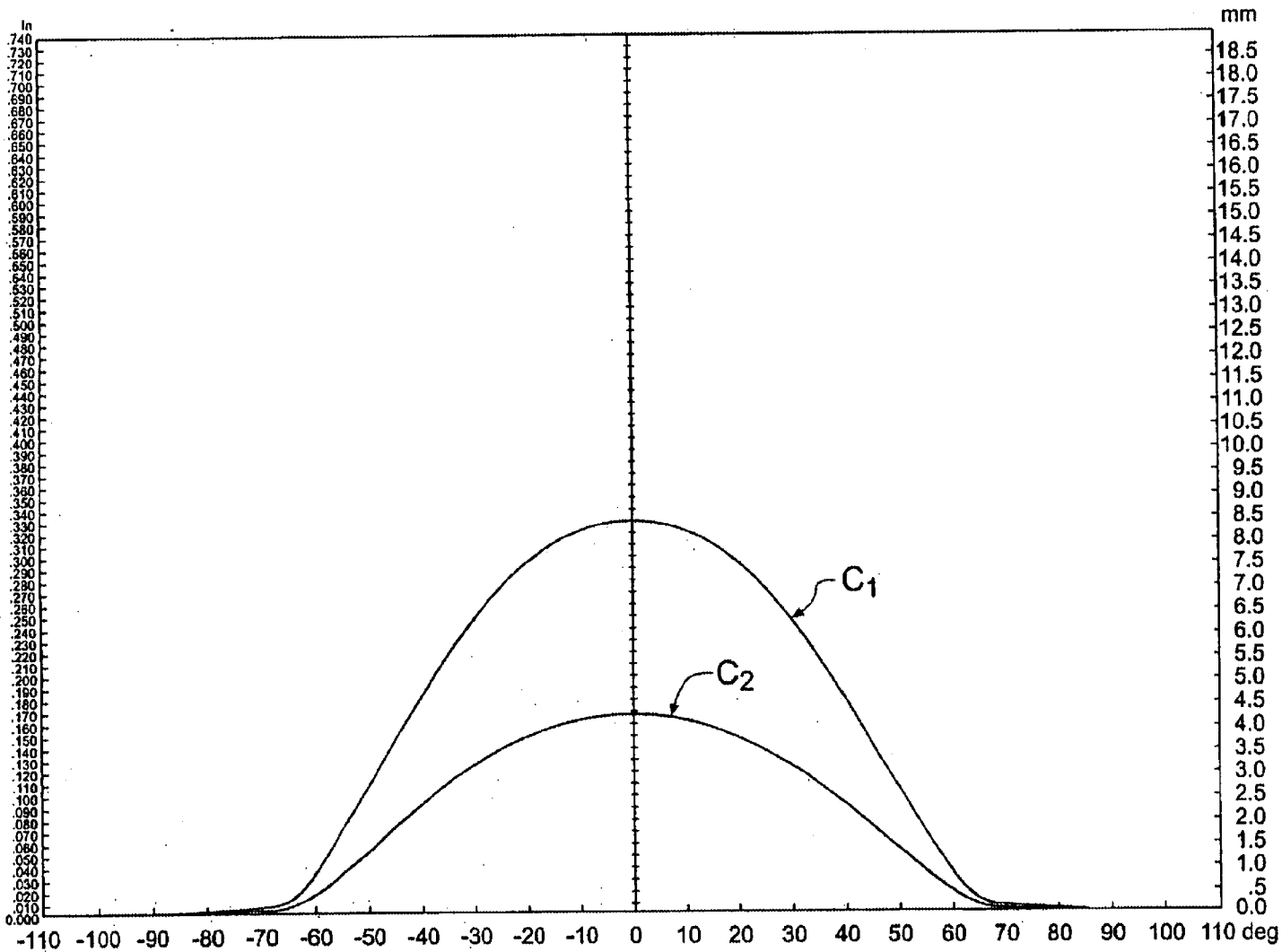
FIG. 3 illustrates two valve/cam lift plots.

FIG. 3 illustrates the valve/cam lift plot obtained with a cam having the profile shown in FIG. 2. In FIG. 3, curve $C_1$ corresponds to the roller position 16*c* of FIG. 2; and curve $C_2$ corresponds to the roller position 16*b* of FIG. 2. There is no valve/cam lift with the roller position 16*a*.

In order to improve fuel economy, a VVLDT system in accordance with this invention may be used—for example, with a cam such as that shown in FIG. 2 located to control operation of, say, cylinders 2 and 3 of one bank of a V8 engine. These are termed "disabled cylinders". The other cylinders could be associated with more conventional cams, designed to provide comparable lifts and durations throughout the range from maximum lift to the selected lower lift level, and with duration extremes chosen to match the disabled cylinder(s) in the normal low-to-high lift range (e.g. between the levels corresponding to roller positions 16*b* and 16*c* of FIG. 2).

What is claimed is:

1. A valve control mechanism, comprising:

a camshaft carrying a plurality of cams, wherein the cams are adapted to cooperate with and to actuate valves which control the induction of fluids into, and the exhaustion of fluids from, a combustion cylinder during the operating cycle of an engine, wherein said camshaft includes a longitudinal axis, wherein said camshaft is movable along said longitudinal axis within a predetermined range of movement;

wherein at least one of the cams in the plurality of cams has a profile which, when viewed in a plane perpendicular to the longitudinal axis of the camshaft, varies as a function of the position along the longitudinal axis of the camshaft;

wherein said at least one cam acts on a respective one of said valves through a cam follower which includes a cam follower body and a cam contracting member which is pivotable relatively to the cam follower body for alignment with the cam; and wherein the profile of said one cam is such that, when the camshaft is moved axially to an extreme of its permitted movement, interaction between the cam and the valve with which it is associated generates no valve movement when the cam is rotated, wherein the profile of said at least one cam includes a profile surface having a minimum distance ($d_1$) from the longitudinal axis of the camshaft, wherein said minimum distance ($d_1$) is smaller than the radius ($d_2$) of a base circle of the cam.

2. A valve control mechanism as claimed in claim 1, wherein the profile of the said at least one cam is such that at one axial end of the cam, the cam surface has a circular portion which coincides with the base circle of the cam, and an elliptical portion which extends from the circular portion at a decreasing distance from the longitudinal axis of the camshaft to a location midway along the elliptical portion at which location the cam surface has said minimum distance from the longitudinal axis of the camshaft.

3. A valve control mechanism as claimed in claim 2, wherein the circular portion of the cam surface extends over an arc of substantially 180° about the longitudinal axis of the camshaft.

4. A valve control mechanism as claimed in claim 1, wherein the cam profile is such that the cam surface includes a base position along the longitudinal axis of the camshaft at which a line extending around the cam surface is circular with a diameter equal to that of the base circle.

5. A valve control mechanism as claimed in claim 4, wherein the cam surface extends from the said base position to a first axial end of the cam at which the cam surface has the said minimum distance from the axis of the camshaft, and wherein the cam contacting member includes a cam contacting surface having a length measured along the cam surface which is not greater than double the distance, measured along the cam surface, from the first axial end of the cam to the base position.

* * * * *